US006332819B1

(12) United States Patent
Emmons

(10) Patent No.: US 6,332,819 B1
(45) Date of Patent: Dec. 25, 2001

(54) OBJECT RETRIEVAL DEVICE USED IN WATER

(76) Inventor: Jerrold K. Emmons, 1024 Brooks End Ct., Columbus, OH (US) 43204

( * ) Notice: Subject to any disclaimer, the term of this patent is extended or adjusted under 35 U.S.C. 154(b) by 0 days.

(21) Appl. No.: 09/672,988

(22) Filed: Sep. 29, 2000

Related U.S. Application Data

(60) Provisional application No. 60/158,231, filed on Oct. 8, 1999.

(51) Int. Cl.[7] ..... B63B 22/00

(52) U.S. Cl. ..... 441/1; 441/7; 441/9; 441/31

(58) Field of Search ..... 441/1, 6, 7, 8, 441/9, 10, 30, 31, 32

(56) References Cited

U.S. PATENT DOCUMENTS

| | | | | |
|---|---|---|---|---|
| 1,007,011 | | 10/1911 | Sekikawa . | |
| 1,208,232 | * | 12/1916 | Taylor | 441/31 |
| 1,476,387 | | 12/1923 | Atwell . | |
| 1,580,227 | | 4/1926 | Wilheim . | |
| 1,659,129 | | 2/1928 | Asaro . | |
| 2,642,693 | * | 6/1953 | Broady | 441/6 |
| 2,749,658 | | 6/1956 | Neumann | 46/92 |
| 2,866,986 | | 1/1959 | Stichling | 9/9 |
| 2,892,198 | * | 6/1959 | Gruenberg | 441/10 |
| 4,198,780 | | 4/1980 | Kubiatowicz | 46/92 |
| 4,312,089 | | 1/1982 | Taylor | 9/8 |
| 4,583,314 | * | 4/1986 | Kirkland | 441/8 |
| 4,705,050 | | 11/1987 | Markham | 128/749 |
| 5,000,482 | | 3/1991 | Cimino | 280/809 |
| 5,133,683 | | 7/1992 | Dorfman | 446/73 |
| 5,387,147 | | 2/1995 | Ohshima et al. | 446/224 |
| 5,600,873 | | 2/1997 | May | 24/3.2 |
| 5,727,974 | | 3/1998 | Wiebenson | 441/24 |

FOREIGN PATENT DOCUMENTS

| | | |
|---|---|---|
| 70764 | 3/1950 | (DK) . |
| 1338504 | 7/1971 | (GB) . |
| WO 94/27695 | 12/1994 | (WO) . |

* cited by examiner

*Primary Examiner*—Stephen Avila
(74) *Attorney, Agent, or Firm*—Richard C. Litman

(57) ABSTRACT

A water retrieval device that is attached to a valuable item to prevent that item from sinking and being lost in muddy or deep water. The device may be in the shape of a latex fish, which contains chemicals that react with the surrounding water that is drawn into the device. Once the device and the attached item are in the water, the device sinks and resurfaces to the top of the water with the reaction of the chemicals releasing carbon dioxide gas within the internal cavity of the device. The device then becomes more buoyant and brings the attached item to the surface of the water, thereby preventing the item from sinking further down into the water. The device can also be brightly covered and can protect a wide variety of items such as wallets, glasses and other valuables.

6 Claims, 6 Drawing Sheets

OBJECT RETRIEVAL DEVICE USED IN WATER

CROSS-REFERENCE TO RELATED APPLICATION

This application claims the benefit of U.S. Provisional Patent Application Ser. No. 60/158,231, filed Oct. 8, 1999.

BACKGROUND OF THE INVENTION

1. Field of the Invention

The present invention relates to a device that is attached to a valuable item and can retrieve that valuable item if it is dropped in muddy or deep water.

2. Description of Related Art

Water sports have always been a popular pastime in this country. Warm climate areas such as Florida, Texas and California, provide their residents with plenty of ocean shoreline, which can be used a large portion of if not the entire calendar year. There are a wide variety of water sports that include swimming, surfing, boating, sailing, fishing and scuba diving to name a few. While participating in these sports, people can easily lose important items such as keys, wallets and glasses.

There are many several ingenious devices in the related art that are designed to keep valuable items from sinking and being lost in deep or muddy water. Some take the form of a lifesaving device as outlined in U.S. Pat. No. 1,476,387 issued to Atwell, while a device, such as that shown in U.S. Pat. No. 2,866,986 issued to Stichling, are specifically designed to retrieve submerged items. Both of these items utilize basic chemistry to make their devices more buoyant and enable them to rise to the surface of a large body of water.

Other devices that utilize basic chemistry to make a particular sinking object more buoyant are outlined in U.S. Pat. No. 4,198,780 issued to Kubiatowicz, U.S. Pat. No. 2,749,658 issued to Neumann, U.S. Pat. No. 1,659,129 issued to Asaro and U.S. Pat. No. 1,007,011 issued to Sekikawa.

The chemistry used behind these inventions is simple. Baking soda, together with citric acid or tartaric acid react in contact with water. The device regulates the movement of water with its contact with the chemicals, which release carbon dioxide as a bi-product, which makes the toy or item lighter than the water that it is in, and results in the item rising to the surface of the water.

The actual principle and invention have already been implemented and are outlined in U.S. Pat. No. 2,866,986 issued to Stichling. The device outlined in the Stichling patent utilizes calcium carbide or Alka-Seltzer to generate a gas upon exposure to water. Once the chemicals are exposed to water, the gas is formed and the device, attached to the object, rises to the top of the water.

The device outlined in the Stichling patent is over 40 years old and still works effectively. However, the Stichling patent can be improved with a better design and the use of modern materials. That is what the present invention does, it takes a proven technology and improves it with a better design and the use of modern materials.

None of the above inventions and patents, taken either singly or in combination, is seen to describe the instant invention as claimed.

SUMMARY OF THE INVENTION

The invention is in the shape of a latex fish (in one preferred embodiment), which contains chemicals that react with the surrounding water that is drawn into the device. Once the device and the protected object are in the water, the device sinks and resurfaces to the top of the water with the reaction of the chemicals releasing carbon dioxide gas within the internal cavity of the device. The device becomes more buoyant and brings the protected item to the surface of the water. The device can also be brightly covered and can protect a wide variety of items such as wallets, glasses and other valuables.

Accordingly, it is a principal object of the invention to provide a water retrieval device that is attached to a valuable item to prevent that item from sinking and being lost in muddy or deep water.

It is another object of the invention to provide a water retrieval device which is made of material which is more expansive and buoyant than plastic or metal water retrieval devices.

It is a further object of the invention to provide a water retrieval device that can retrieve larger and heavier valuable items than current water retrieval devices.

Still another object of the invention is to provide a water retrieval device that is made of biodegradable materials.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
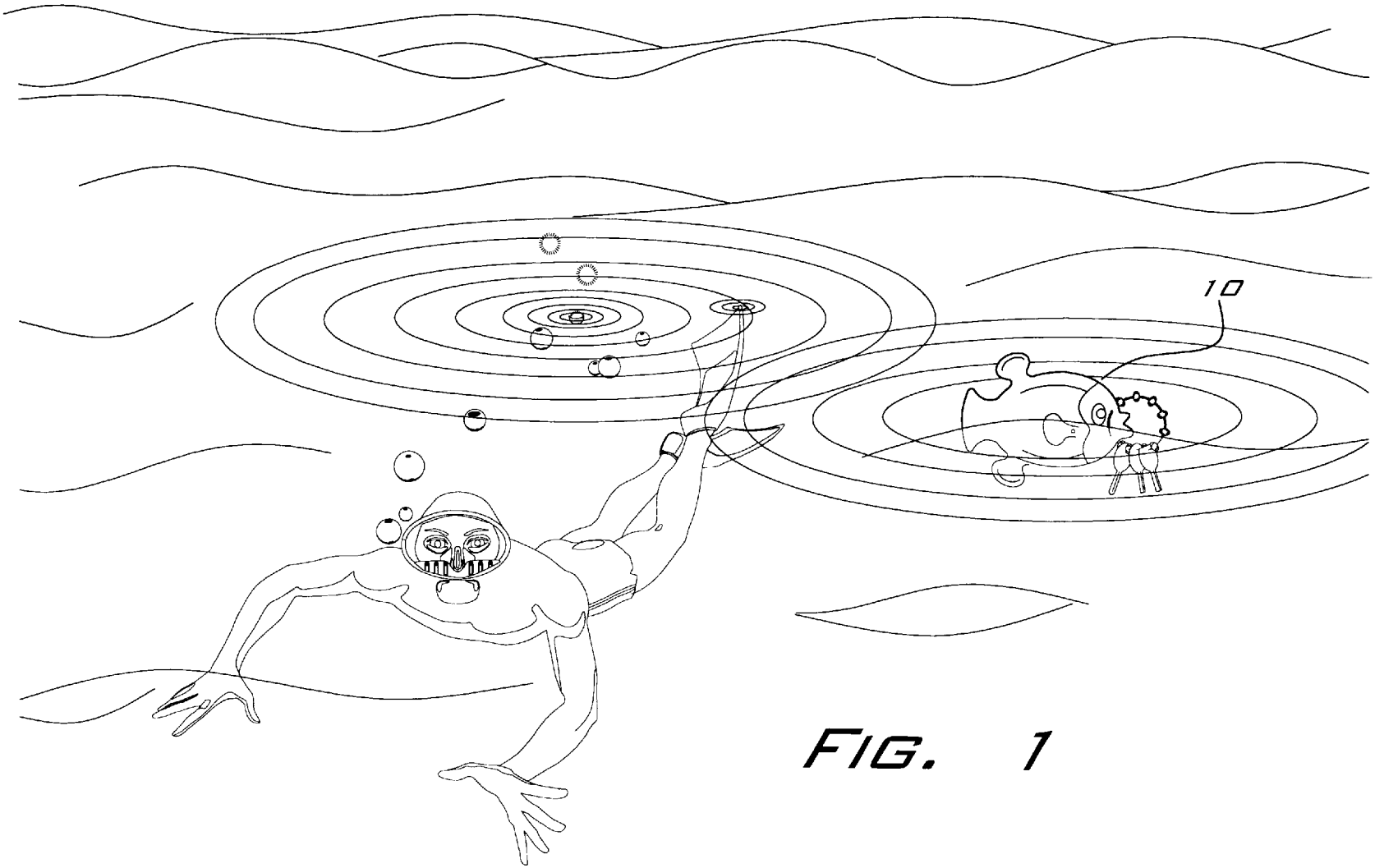
FIG. 1 is an environmental, perspective view of an object retrieval device used in water according to the present invention.

The present invention is an object retrieval device used in water 10. As generally shown in FIG. 1, the object retrieval device 10 has a body 20 (FIG. 2), an outer surface 90 (FIG. 4) and internal cavity 80 (FIG. 4) that is made of expandable and contractible latex material.

While the invention may take any one of a wide variety of forms and shapes, it has the appearance of a fish in a preferred embodiment of the invention illustrated in the drawing figures.

As shown in FIGS. 2–6, the object retrieval device 10 comprises a water induction means, internal chemical containment bands 60, a gas-generating means within the internal cavity 80, a pressure release means on the outer surface 90 of the device 10, a solid body front 70 made of dense expandable and contractible material, and an attachment means for attaching retrieved items to the device 10.

Figure 2:
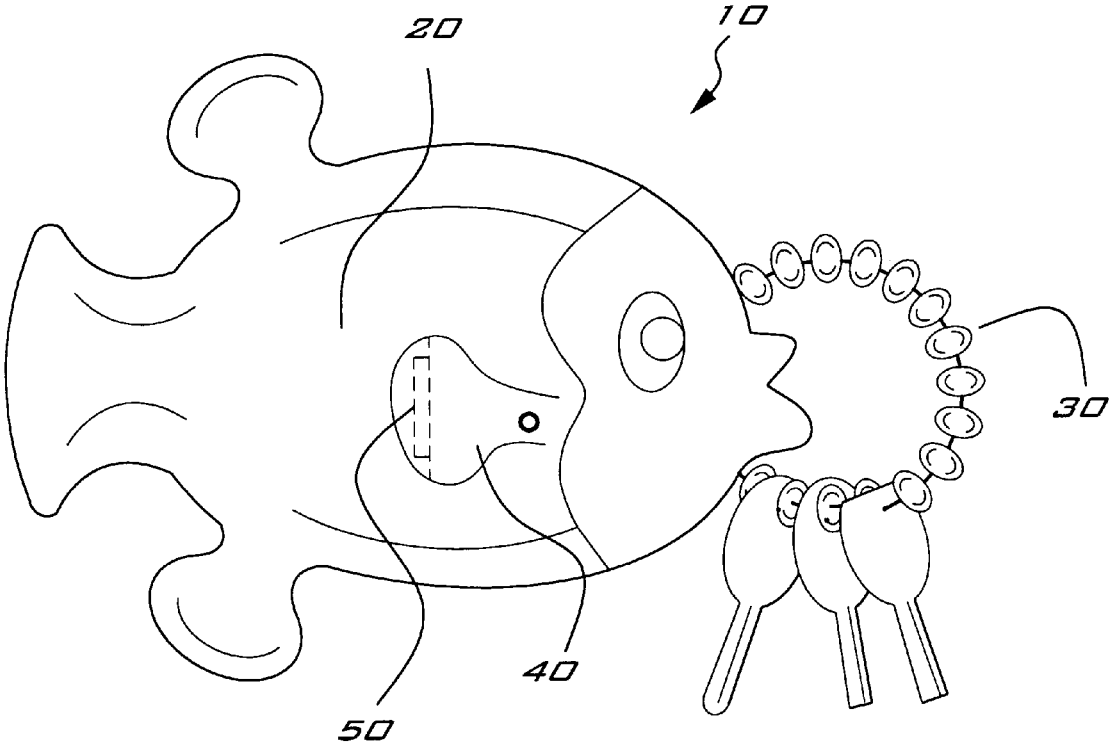
FIG. 2 is a side perspective view of an object retrieval device used in water.

According to FIG. 2, the water induction means is a thin outer layer 40 resembling a fish gill that loosely covers an aperture 50 which allows water from the exterior of the device 10 to travel into the internal cavity 80 of the device 10. This outer layer 40 is also made of latex, but is thinner than the outer surface 90. There is also a thin inner layer 100 (See FIG. 4) that loosely covers the aperture 50 from the internal cavity 80 as well to prevent the escape of gas generated by the reaction of water with the chemical contained within bands 60. There is also an attachment means which is a small bead-type chain 30 that attaches the valued item to the device 10. The chain 30 is molded as part of the body 20 of the device 10 and can be substituted with a nylon rope or cord material. Although the device 10 is attached to a key ring, the device 10 can also be attached to other small valuable items such as wallets or glasses to prevent them from being lost in deep or muddy water.

Figure 3:
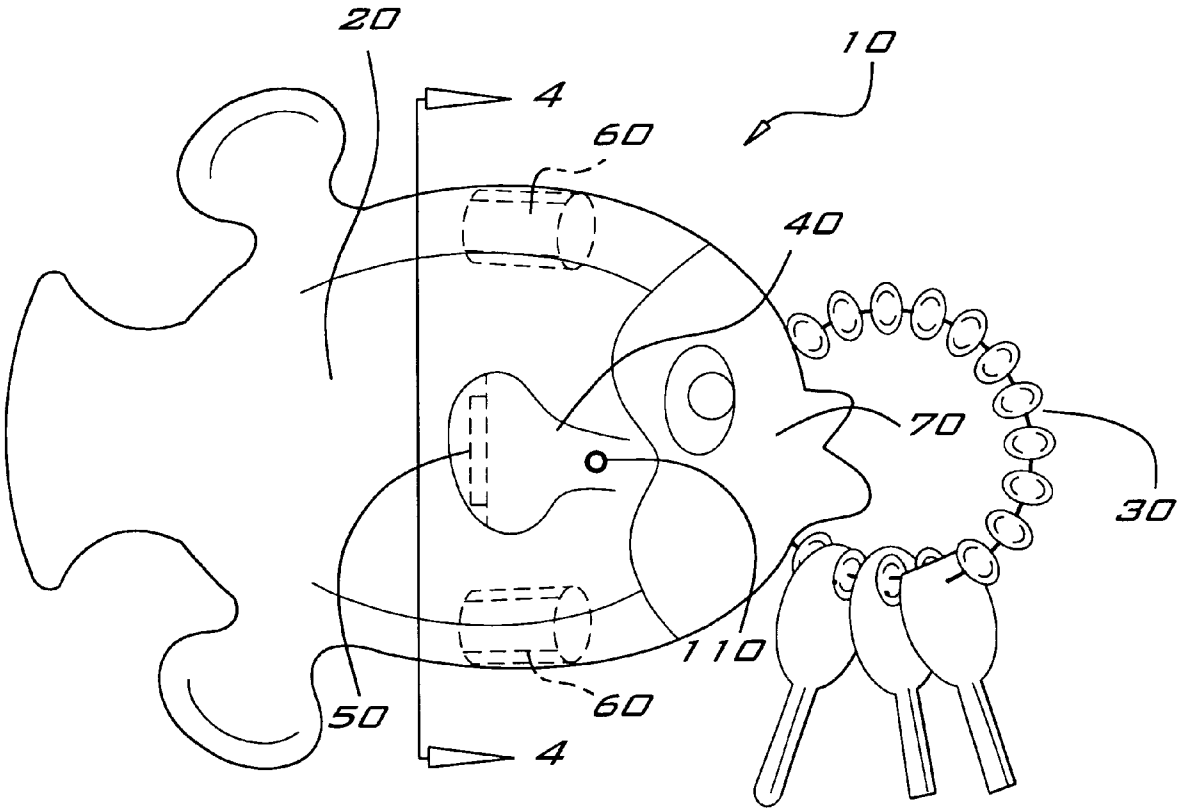
FIG. 3 is a transparent side perspective view of an object retrieval device used in water.

FIG. 3 depicts a pressure release means on the outer surface 90 of the device 10, which is a puncture hole 110 that extends from the outer surface 90 to the internal cavity 80. At deeper water levels, as the device 10 rises, it will expand greatly. The puncture hole 110 will also expand and allow excess gas to escape from the internal cavity 80. If the excess gas is not released, the result in the device 10 bursting from the built-up pressure caused by the presene of excess gas.

FIG. 3 also depicts the front portion 70 of the device 100, which is made of a denser solid latex. This provides some added structure and rigidity to the body 20 of the device 10, which would otherwise be too flaccid.

Figure 4:
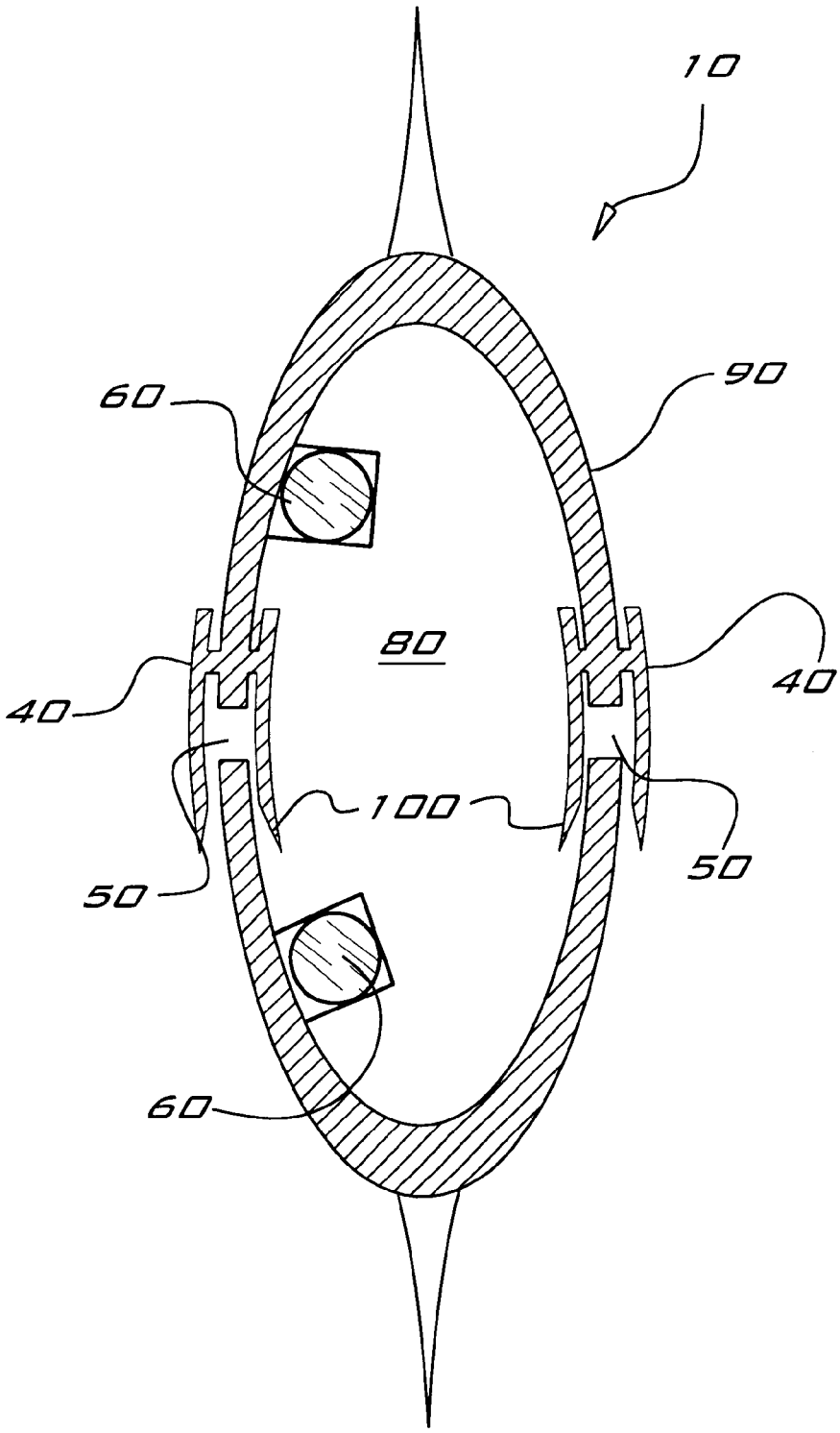
FIG. 4 is a cross-sectional view, taken along lines 4—4 of FIG. 3.

FIG. 4 outlines the internal chemical containment bands 60, which hold the gas producing chemicals. The chemicals within the internal chemical containment bands 60 are sodium bicarbonate and citric acid, which are combined together in tablet form. Approximately 1,700 mgs. of sodium bicarbonate and 1,000 mgs. of citric acid are contained in each tablet, with the device 10 holding 1–3 tablets.

FIG. 4 also depicts the gas-generating means within the internal cavity 80, which comes as a result of the reaction of the chemicals within the internal chemical containment bands 60 with the water from the water induction means. Note that the chemicals will react equally as well with saltwater as they would with freshwater and can utilize other carbon dioxide generating chemicals that react with water such as calcium carbonate and Alka-Seltzer.

These chemicals and their reactions with water are well-known in the art. The improvement or point of novelty with the device 10 is the use of a latex body 20, which expands more easily and can hold a greater volume of produced gas than a metal or plastic body. The effect of using the latex body 20 is that the device 10 becomes more buoyant than if a less expansive material is used for the body 20 of the device 10. Therefore, the device 10 can retrieve larger and heavier items than devices made with less expansive materials.

Figure 5:
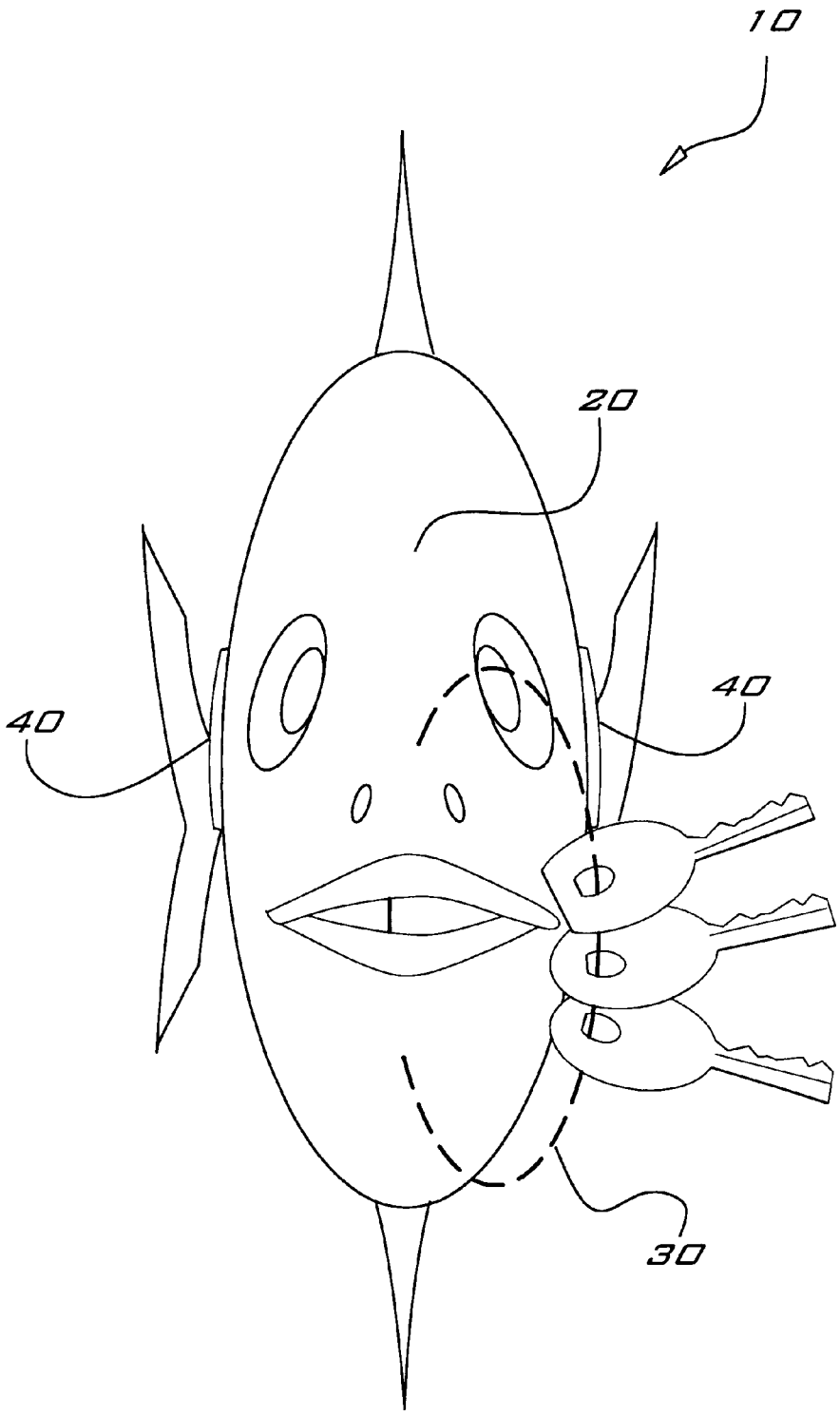
FIG. 5 is a front elevational view of the invention when deflated.
Figure 6:
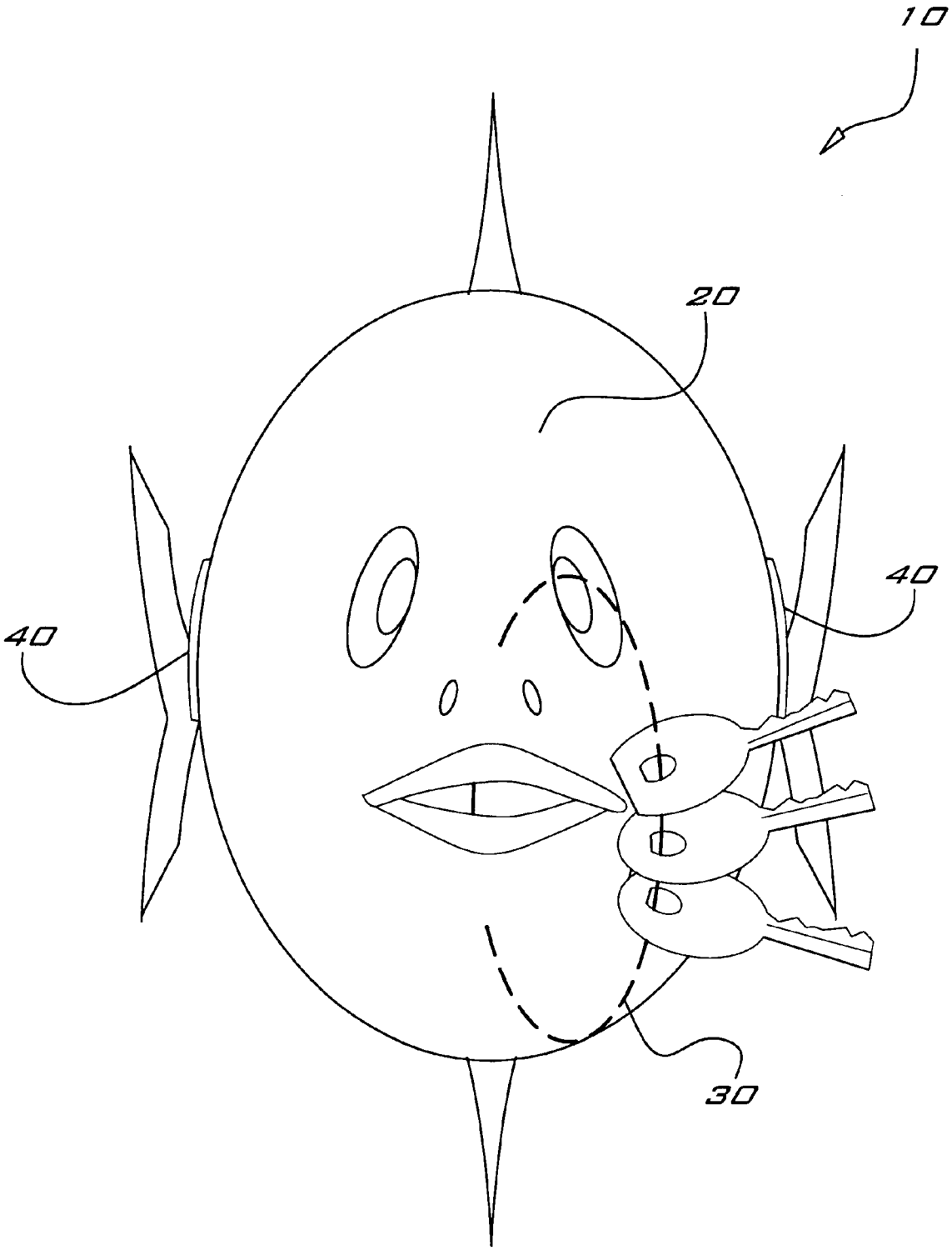
FIG. 6 is a front elevational view of the invention when inflated.

FIG. 5 and FIG. 6 illustrate a view of the device 10 before going into the water and how it expands once it is in the water. Latex offers the ability to expand and still retain and return to its original size and shape. Latex can be used over and over again and is buoyant enough to support a wider variety of items. The latex can also be decorated in bright and attractive colors and can also be made with glow-in-the-dark colorant. The latex and carbon dioxide associated with this device is also biogradable, unlike other synthetic materials which take much longer to breakdown.

It is to be understood that the present invention is not limited to the embodiments described above, but encompasses any and all embodiments within the scope of the following claims.

I claim:

1. A device for retrieving items submergible in water, said device comprising:

a body made of an expandable material and having an outer surface configured to define a fish appearance, said body defining an internal cavity and a set of apertures;

at least one band disposed within the cavity of said body, said band containing a chemical that generates a gas upon reaction with water;

a thin outer layer resembling a fish gill and a thin inner layer, said inner and outer layers covering each of the apertures, said outer layer allowing water to enter the cavity of said body and said inner layer preventing escape of the gas generated within the cavity when the water reacts with said chemical;

means for releasing pressure produced within the cavity of the body when the gas is generated; and means for attaching a retrievable item to said body.

2. The device according to claim 1, wherein said material is latex.

3. The device according to claim 2, wherein said body includes a front section made of a relatively dense latex material.

4. The device according to claim 1, wherein said pressure releasing means is a puncture hole on the said outer surface of said body.

5. The device according to claim 1, wherein said attaching means is a bead-type chain.

6. The device according to claim 1, wherein the chemical that generates the gas is a mixture of sodium bicarbonate and citric acid.

* * * * *